United States Patent [19]

Pierce

[11] 4,216,039

[45] Aug. 5, 1980

[54] SMOKELESS PROPELLANT COMPOSITIONS HAVING POLYESTER OR POLYBUTADIENE BINDER SYSTEM CROSSLINKED WITH NITROCELLULOSE

[75] Inventor: Everette M. Pierce, Somerville, Ala.

[73] Assignee: The United States of America as represented by the Secretary of the Army, Washington, D.C.

[21] Appl. No.: 962,273

[22] Filed: Nov. 20, 1978

[51] Int. Cl.[2] ..... C06B 45/10

[52] U.S. Cl. ..... 149/19.4; 149/19.5; 149/19.8; 149/19.9; 149/92

[58] Field of Search ..... 149/19.4, 19.8, 19.5, 149/19.9, 92

[56] References Cited

U.S. PATENT DOCUMENTS

| | | | |
|---|---|---|---|
| 3,245,849 | 4/1966 | Klager | 149/19.4 |
| 3,711,344 | 1/1973 | Pierce | 149/100 |
| 3,726,729 | 4/1973 | Pierce | 149/19.8 |
| 3,798,090 | 3/1974 | Allabashi | 149/19.4 |
| 3,853,646 | 12/1974 | Frankel et al. | 149/19.4 |
| 3,956,890 | 5/1976 | Davis | 149/19.8 |
| 4,012,245 | 3/1977 | Voigt et al. | 149/19.8 |
| 4,038,115 | 7/1977 | Dehm | 149/19.4 |
| 4,052,943 | 10/1977 | Elrick | 149/19.4 |
| 4,092,188 | 5/1978 | Lovelace | 149/19.4 |

*Primary Examiner*—Edward A. Miller

*Attorney, Agent, or Firm*—Nathan Edelberg; Robert P. Gibson; Jack W. Voigt

[57] ABSTRACT

The propellant compositions of this invention are crosslinked with from about 0.1 to about 1.0 weight percent of nitrocellulose which improves the physical properties and the thermal stabilities of these propellants thereby permitting their storing and testing up to 165° F. These propellants employ additional ingredients which include one or more binder ingredients selected from the group consisting of polyglycol adipate (PGA), polyethylene glycol (PEG), polycapralactone (PCL or PCP), and hydroxy-terminated polybutadiene (HTPB); plasticizer ingredients selected from the nitrate ester plasticizers consisting of nitroglycerin (NG), trimethylol ethane trinitrate (TMETN), triethylene glycol dinitrate (TEGDN), and butane trioltrinitrate (BTTN); oxidizer ingredient selected from the group consisting of cyclotetramethylenetetranitramine (HMX), cyclotrimethylenetrinitramine (RDX), triaminoguanidine nitrate (TAGN), and oxamide; thermal stabilizers selected from the group consisting of 2-nitrodiphenylamine, 4-nitrodiphenylamine, n-methyl-p-nitroaniline, and resorcinol; isocyanate curing agent; carbon black additive; and a modifying additive selected from ballistic additives and curing catalyst additives.

3 Claims, 1 Drawing Figure

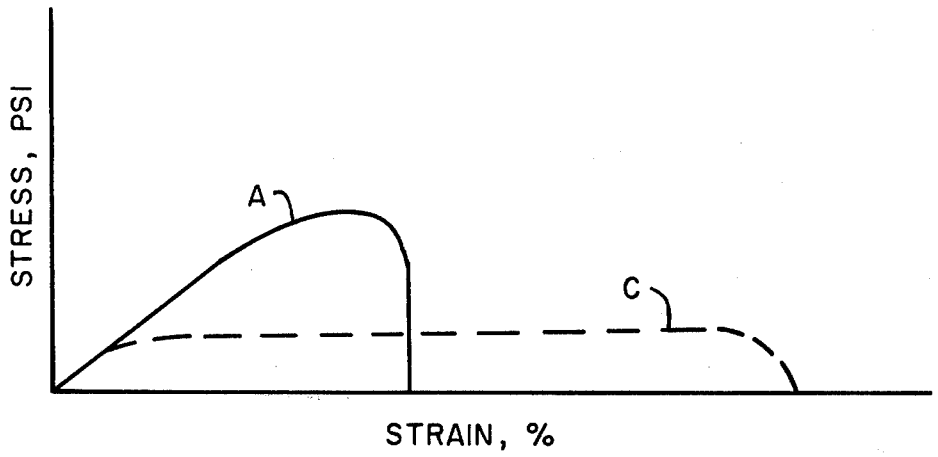
STRESS, PSI
A
C
STRAIN, %

SMOKELESS PROPELLANT COMPOSITIONS HAVING POLYESTER OR POLYBUTADIENE BINDER SYSTEM CROSSLINKED WITH NITROCELLULOSE

DEDICATORY CLAUSE

The invention described herein may be manufactured, used, and licensed by or for the Government for governmental purposes without the payment to me of any royalties thereon.

BACKGROUND OF THE INVENTION

Nitrocellulose propellants have been made and used many years. These propellants have generally utilized from about 10 to 60% weight percent of nitrocellulose as the binder. A characteristic of nitrocellulose propellants is their tendency to undergo degradation after storage. With the best known stabilizers to date, nitrocellulose propellants degrade when stored higher than 122° F.

Nitrocellulose has been utilized in crosslinked nitrocellulose propellants. A method of processing of crosslinked nitrocellulose propellants to prevent gassing of the propellant is disclosed in my U.S. Pat. No. 3,711,344 assigned to the United States of America as represented by the Secretary of the Army. The nitrocellulose content of the propellant composition produced by the disclosed process ranged from about 5 to about 25 weight percent of the propellant composition.

Nitrocellulose has also been utilized with hydroxy-terminated polybutadiene as the binder. My U.S. Pat. No. 3,726,729 assigned to the United States of America as represented by the Secretary of the Army discloses propellant compositions which utilizes nitrocellulose in amounts from about 5 to 40 weight percent and hydroxy-teminated polybutadiene in amounts from about 1 to about 15 weight percent. These propellants were smoky propellants containing aluminum and ammonium perchlorate.

The combination of a nitrocellulose binder with an explosive nitrate ester plasticizer such as nitroglycerin is designated "double-base propellant composition". When high energy and oxidizer materials such as powdered aluminum and ammonium perchlorate are also included in a double-base composition, the composition is then designated "composite double-base propellant composition". A problem associated with the double-base or composite double-base propellant has been the attainment of proper thermal stability in the higher temperature range. Thus the actual "high-temperature thermal stability" has been evaluated by means of a standard 120° C. deflagration test wherein the sample is held at 120° C. until deflagration, or self ignition at a constant temperature, occurs. The testing results are reported in time to deflagration at 120° C., minutes The typical valves of the control and the test propellant compositions, as illustrated in column 5 of U.S. Pat. No. 3,726,729 vary from about 550 to about 600 minutes for the control propellant containing nitrocellulose as the binder to over 2,000 when hydroxy-terminated polybutadiene is included as part of the binder for the composition.

SUMMARY OF THE INVENTION

Nitrocellulose is employed as a crosslinking additive, in amounts from about 0.10 weight percent to about 1.0 weight percent, in solid propellants employing a binder ingredient selected from the binder ingredients consisting of hydroxy terminated polybutadiene, polyethylene glycol, polycapralactone, and polyglycol adipate.

Exemplary of the performance of nitrocellulose (NC) as a crosslinking additive is when 0.25% to 0.5% nitrocellulose is added to a polycapralactone or polyethylene glycol binder system for propellants. This amount of NC additive increases the stress and modulus 40% to 100% while maintaining usable strain at low temperature (−40° F., 20 to 50%) and strain values to 100% at 75° F. Improvements have been demonstrated when NC as an additive has been used in double-base propellants. For example, small concentrations of NC additive, 0.5% to 1.0%, improve the thermal stability of the double-base propellants.

BRIEF DESCRIPTION OF THE DRAWING

The FIGURE of the drawing is a propellant stress-strain curve which depicts the improvements in properties achieved by the additive nitrocellulose as compared to a control propellant wherein no additive of nitrocellulose was employed.

DESCRIPTION OF THE PREFERRED EMBODIMENT

Nitrocellulose when employed as a crosslinker in an amount from about 0.10 to about 1.00 weight percent of the propellant composition of this invention results in improved thermal stability and improved physical properties.

The binder ingredient is selected from the group consisting of polyglycol adipate (PGA), polyethylene glycol (PEG), polycapralactone (PCL or PCP), and hydroxy terminated polybutadiene. Table I below sets forth illustrative propellant compositions which employ 0.1–0.5% NC crosslinker. These propellant compositions are identified for convenience by listing coded abbreviations for the ingredients which are further identified below Table I. The weight percent concentration and possible combinations of ingredients indicates the many improved propellant compositions which can be formulated and crosslinked with NC.

TABLE I

NC CROSSLINKED PROPELLANTS

| Ingredient* | Wt. % Concentration & Possible Combinations | | | | | | |
|---|---|---|---|---|---|---|---|
| Nitrocellulose | 0.1–0.5 | + | + | + | + | + | + |
| Nitrate Esters | 10–30 | + | + | + | − | + | + |
| Oxidizers | 10–80 | + | + | + | + | + | + |
| Stabilizers (Thermal) | 0.2–2.0 | + | + | + | + | + | + |
| Ballistic Additives | 0.0–4.0 | + | + | + | + | + | + |
| PCP | 1–10.0 | + | + | − | − | − | − |
| PEG | 1–10.0 | − | + | − | − | + | + |
| HTPB | 1–10.0 | − | − | + | + | − | + |
| PGA | 1–10.0 | + | − | + | + | + | + |
| Carbon | 0.1–1.0 | + | + | + | + | + | + |
| Isocyanate | 0.3–2.0 | + | + | + | + | + | + |

−indicates ingredient not present
+indicates ingredient present, except where optional range is from zero wt. %
*Identified in further detail on next page.
PCL - polycapralactone
PCP - polycapralactone polymer
PEG - polyethylene glycol
PGA - polyglycol adipate
HTPB - hydroxy terminated polybutadiene, as noted above these may be used alone or in combination.

Thermal Stabilizers-2-nitrodiphenylaime, 4-nitrodiphenyamine, n-methyl-p-nitroaniline, resorcinal, etc.

Modifying additives are used in amounts as required to achieve desired ballistic properties and/or curing rates, for example, triphenyl bismuth (TPB) can be used to accelerate the cure of propellant, that is, if a shortened cure time is desired.

Table II, below, titled: "Experimental Propellants Using NC as Crosslinker", sets forth the ingredients in weight percent for experimental compositions A-1 and A-2 and the respective control compositions C-1 and C-2 along with physical property measurements for each specified composition. The compositions without NC crosslinker are very soft with the consistency of bubble gum very much stretch but no strength. The NC crosslinker toughens the propellant while maintaining sufficient strain.

TABLE II

EXPERIMENTAL PROPELLANTS USING NC AS CROSSLINKER

| Ingredient | Composition A-1 | Control Composition C-1 |
|---|---|---|
| PCP | 7.14 | 7.64 |
| TMETN | 15.00 | 15.00 |
| HMX | 75.80 | 75.80 |
| NC | 0.50 | — |
| TMDI | 1.34 | 1.34 |
| CB | 0.20 | 0.20 |
| TPB | 0.02 | 0.02 |
| Strain, % | 50 | 150 |
| Stress, Psi | 74 | 24 |
| Modulus, Psi | 894 | 78 |
| Ingredient | Composition A-2 | Composition C-2 |
| PEG | 8.78 | 9.08 |
| TMETN | 18.40 | 18.40 |
| HMX | 70.00 | 70.00 |
| NC | 0.30 | — |
| N-100 | 1.30 | 1.30 |
| CB | 0.20 | 0.20 |
| $Pb_3O_4$ | 1.00 | 1.00 |
| TPB | 0.02 | 0.02 |
| Strain, % | 60 | 200 |
| Stress, Psi | 120 | 40 |
| Modulus, Psi | 600 | 250 |

CB - carbon black
TMDI - trimethyl hexamethylene diisocyante
N-100 - Desdumur's trifunctional isocyanate
TPB - triphenyl bismuth (cure catalyst)

The improvement in physical properties and thermal stabilities of smokeless propellants employing nitrocellulose as a crosslinker in an amount from about 0.1 to about 1.0 weight percent of the propellant composition is unexpected. The thermal stability of nitrocellulose propellants employing a much larger amount of nitrocellulose are considered stable only to about 120° F. The combination of nitrocellulose as a crosslinker as specified along with the other ingredients of the smokeless propellants of this invention permits storage and testing of these propellants up to 165° F. whereas propellants containing higher levels of nitrocellulose (e.g., 5 percent or more nitrocellulose) degrade when stored higher than 122° F. Thus, the investigations under this invention show that nitrocellulose (NC) improves thermal stability only by decreasing the concentration in a modified double-base composition. Hence, small amounts, 0.10 to 1.0%, NC do not improve thermal stability over 0% NC but such low concentrations do not degrade thermal stability.

In regards to the improvement of physical properties, as a result of crosslinking function of NC, it is essential that the NC be in solution or dissolved or be well dispersed; therefore, adding the NC with the plasticizer at beginning of mix is recommended. The NC can be dissolved in the nitrate ester plasticizer or alternately, the NC can be dissolved in an acetone solution which can subsequently be removed during the mixing under vacuum.

I claim:

1. A smokeless propellant composition having a binder system crosslinked with nitrocellulose comprising:

(i) one or more binder ingredients selected from the group of binder ingredients consisting of polyglycol adipate, polyethylene glycol, polycapralactone, and hydroxy-terminated polybutadiene in an amount from about 1 to about 10 weight percent of said smokeless propellant composition;

(ii) nitrocellulose which functions as a crosslinking agent for said binder ingredients in an amount from about 0.1 to 1.0 weight percent of said smokeless propellant composition;

(iii) plasticizer ingredients selected from the nitrate ester plasticizers consisting of nitroglycerin, trimethylol ethane trinitrate, triethylene glycol dinitrate and butane trioltrinitrate in an amount from about 10 to about 30 weight percent of said smokeless propellant composition;

(iv) an oxidizer ingredient selected from the group of oxidizer ingredients consisting of cyclotetramethylenetetranitramine, cyclotrimethylenetrinitramine, triaminoguanidine nitrate, and oxamide in an amount from about 10 to about 80 weight percent of said smokeless propellant composition;

(v) thermal stabilizers selected from the group of thermal stabilizers consisting of 2-nitrodiphenylamine, 4-nitrodiphenylamine, n-methyl-p-nitroaniline, and resorcinol in an amount from about 0.2 to about 2.0 weight percent of said smokeless propellant composition;

(vi) carbon black additive in an amount from about 0.1 to about 1.0 weight percent of said smokeless propellant composition;

(vii) a modifying additive selected from ballistic additives and curing catalyst additives in an amount from about 0 to 4.0 weight percent of said smokeless propellant composition; and (viii) an isocyanate curing agent in an amount from about 0.3 to about 2.0 weight percent of said smokeless propellant composition.

2. The smokeless propellant composition of claim 1 wherein said binder ingredient selected is polycapralactone which is present in an amount of about 7.14 weight percent; said nitrocellulose is present in an amount of about 0.50 weight percent; said plasticizer selected is trimethylol ethane trinitrate which is present in an amount of about 15.00 weight percent; said oxidizer ingredient selected is cyclotetramethylenetetranitramine which is present in an amount of about 75.80 weight percent; said isocyanate curing agent is trimethyl hexamethylene diisocyanate which is present in an amount of about 1.34 weight percent; said carbon black additive is present in an amount of about 0.20 weight percent; and wherein said modifying additive is a curing catalyst of triphenyl bismuth which is present in an amount of about 0.02 weight percent.

3. The smokeless propellant composition of claim 1 wherein said binder ingredient selected is polyethylene glycol which is present in an amount of about 8.78 weight percent; said nitrocellulose is present in an amount of about 0.30 weight percent; said plasticizer selected is trimethylol ethane trinitrate which is present in an amount of about 18.40 weight percent; said oxidizer selected is cyclotetramethylenetetranitramine which is present in an amount of about 70.00 weight percent; said isocyanate curing agent is a trifunctional isocyanate which is present in an amount of about 1.30 weight percent; said carbon black additive is present in an amount of about 0.20 weight percent; said modifying additive is a ballistic additive of $Pb_3O_4$ which is present in an amount of about 1.00 weight percent and a curing catalyst of triphenyl bismuth which is present in an amount of about 0.02 weight percent.

* * * * *